United States Patent [19]

Feuchter et al.

[11] 4,235,279

[45] Nov. 25, 1980

[54] APPARATUS FOR COOLING A CONTINUOUS CASTING MOLD

[75] Inventors: Peter Feuchter, Oberhausen; Ulrich Katschinski; Erling Roller, both of Essen, all of Fed. Rep. of Germany

[73] Assignee: Fried. KRUPP Gesellschaft mit beschränkter Haftung, Essen, Fed. Rep. of Germany

[21] Appl. No.: 918,706

[22] Filed: Jun. 26, 1978

[30] Foreign Application Priority Data

Jun. 28, 1977 [DE] Fed. Rep. of Germany ..... 2728993

[51] Int. Cl.[3] ..... B22D 11/24

[52] U.S. Cl. ..... 164/443; 164/440; 165/169

[58] Field of Search ..... 164/443, 444, 82, 348; 249/79, 80; 165/169, DIG. 8, DIG. 7, DIG. 10

[56] References Cited

U.S. PATENT DOCUMENTS

| | | | |
|---|---|---|---|
| 484,784 | 10/1892 | Emmens | 165/169 |
| 1,836,310 | 12/1931 | Cordes | 164/348 X |
| 2,090,336 | 8/1937 | Stack | 165/169 X |
| 2,946,100 | 7/1960 | Baier et al. | 164/443 X |
| 3,157,921 | 11/1964 | Porter | 164/443 |
| 3,388,737 | 6/1968 | Buckwalter et al. | 164/443 |
| 3,502,135 | 3/1970 | Wertli | 249/79 X |
| 3,592,259 | 7/1971 | Adamec et al. | 164/443 |

FOREIGN PATENT DOCUMENTS

| | | | |
|---|---|---|---|
| 1593773 | 7/1970 | France | 164/443 |

*Primary Examiner*—Robert D. Baldwin
*Assistant Examiner*—J. Reed Batten, Jr.
*Attorney, Agent, or Firm*—Becker & Becker, Inc.

[57] ABSTRACT

A continuous mold with a mold chamber, preferably a rectangular mold chamber, for continuously casting metals, especially copper and copper alloys, which includes a one piece or more piece graphite block and also includes cooling pipes forming components of a cooling circuit and being frictionally connected to the graphite block for improving the heat transfer to the mold chamber of the graphite block. The cooling circuit is structurally separate from the graphite block, and the cooling pipes yieldably engage the outer surface of the graphite block.

5 Claims, 2 Drawing Figures

APPARATUS FOR COOLING A CONTINUOUS CASTING MOLD

The present invention relates to a continuous mold with rectangular mold chamber for continuously casting metals, especially copper and copper alloys. More specifically, the present invention relates to a continuous mold of the just mentioned type which comprises a one or more piece graphite block and cooling pipes which form a component of a cooling circuit and which, for improving the heat transfer to the hollow mold chamber of the graphite block, are frictionally connected thereto.

When continuously casting copper and copper alloys, especially also when casting horizontally, the employment of graphite has, in view of the good lubricating properties combined with a sufficient heat conductivity of the graphite, proved to be very advantageous for making molds of the above mentioned type.

However, graphite is water permeable so that cooling medium effecting the heat withdrawal has to be shielded with regard to the graphite by a water-tight separating layer. In this connection, ingot molds with a copper mantle have become known which mantle is water-cooled and into which a graphite sleeve has been fitted. Such a mold structure, in view of the uniform heating up of the circumference of the mold, does not present any problems if metal strands with round cross section are being cast. However, with molds having a rectangular mold chamber, the above described fitting of the graphite sleeve into the water-cooled copper mantle is possible only under certain conditions. Due to the different course of the temperature over the cross section of the strand and the mold, there exists the danger that the graphite insert will detach itself from the copper mantle preferably on the broad sides of the mold. The heat transfer which is materially affected in case of such detachment results in disorders of the casting process, in a reduction of the quality of the cast articles and in damages to the mold.

To avoid the above described difficulties, it has been suggested to provide a solid graphite mold with cooling bores and to fit oversized cooling pipes into the cooling bores. The coding pipes which under spring load engage the walls of the bores are provided with longitudinal expansion fins which prevent the graphite (as a result of the different expansion of copper and graphite at high temperatures of operation) from being subjected to too high a temperature.

While this design which has been disclosed in German Auslegeschrift No. 1,217,556 has the advantage that always a safe engagement of the cooling pipes on the material from which the mold is made will be assured, the drawback of this known mold consists, however, in that the mold is extremely sensitive and expensive. In particular, the machining of the graphite block as well as the working-in of the cooling bores require considerable labor and expenses. Moreover, there exists the danger that when fitting the cooling pipes into the cooling bores, the graphite may be damaged. Inasmuch as a disassembly of the cooling pipes once they are inserted into the cooling bores is economically hardly feasible, and since the graphite also is subjected to a relatively great wear, the employment of the known above mentioned mold entails high costs. Therefore, it would appear that at best the above known mold could be used for producing large-size strands by vertically casting.

It is therefore an object of the present invention to provide a continuous mold which, on the one hand, incorporates the advantages of the above mentioned known mold, while, on the other hand, requiring only a considerably smaller number of parts and expenses than the heretofore known mold.

It is another object of this invention so to design the continuous mold that the costs for the mold which are to be taken together with the operating costs of the continuous casting installation can be kept relatively low.

The continuous mold according to the present invention with rectangular mold chamber for the continuous casting of metals, especially copper and copper alloys, is characterized primarily in that the cooling circuit is structurally separated from the graphite block, and that the cooling pipes yieldingly engage the outer surface of the graphite block. Thus, the graphite block forms a relatively low cost wear part which can be exchanged without affecting the cooling circuit, i.e. without exchanging the cooling pipes connected to the graphite block by friction only.

To assure a sufficient heat transfer, the outside surface of the graphite block is expediently provided with grooves for receiving the cooling pipes. The cooling pipes may have a circular or a rectangular cross section while the cross section of the grooves is advantageously adapted to the respective shape of the cooling pipes.

According to a preferred embodiment of the invention, the grooves extend parallel to the longitudinal axis of the mold chamber. In this connection, the grooves are arranged on both broad sides of the continuous mold. If necessary, also the two narrow sides of the continuous mold may be provided with correspondingly arranged grooves in which cooling pipes engage the graphite block.

According to a still further development of the invention, the continuous mold may have a mechanically effective pre-loading device by means of which the cooling pipes are held in engagement with the grooves. A preferred embodiment of the invention consists in that the cooling pipes are held in engagement with the grooves by the power which acts upon them due to the controllable static pressure of the cooling fluid.

It is in particular also possible to assure the engagement of the cooling pipes with the grooves of the graphite block by providing a mechanical preloading device and by taking advantage of the static pressure in the cooling fluid in order to press the cooling pipes against the surface of the grooves.

According to a particularly advantageous embodiment of the invention, the cooling pipes are, in view of the interposition of compensators connected to the feeding and discharging sections of the cooling pipes, connected to that part of the cooling circuit which is stationary with regard to the graphite block. These compensators may be so designed and may be so built into the cooling circuit that they keep the cooling pipes in a resilient manner in engagement with the grooves.

According to the invention, each part of the cooling circuit, which communicates with cooling pipes associated with a definite side of the graphite block, has control means of its own for controlling the quantity of the throughflow and the pressure. Thus, if only the two broad sides of the continuous mold are provided with cooling pipes, the respective cooling pipes associated with each other are connected to the cooling circuit in such a way that a separate control of the quantity of the throughflow and of the hydrostatic pressure of the cooling fluid will be possible.

The invention will be better understood by considering the following specification in connection with the accompanying drawings wherein.

Figure 1:
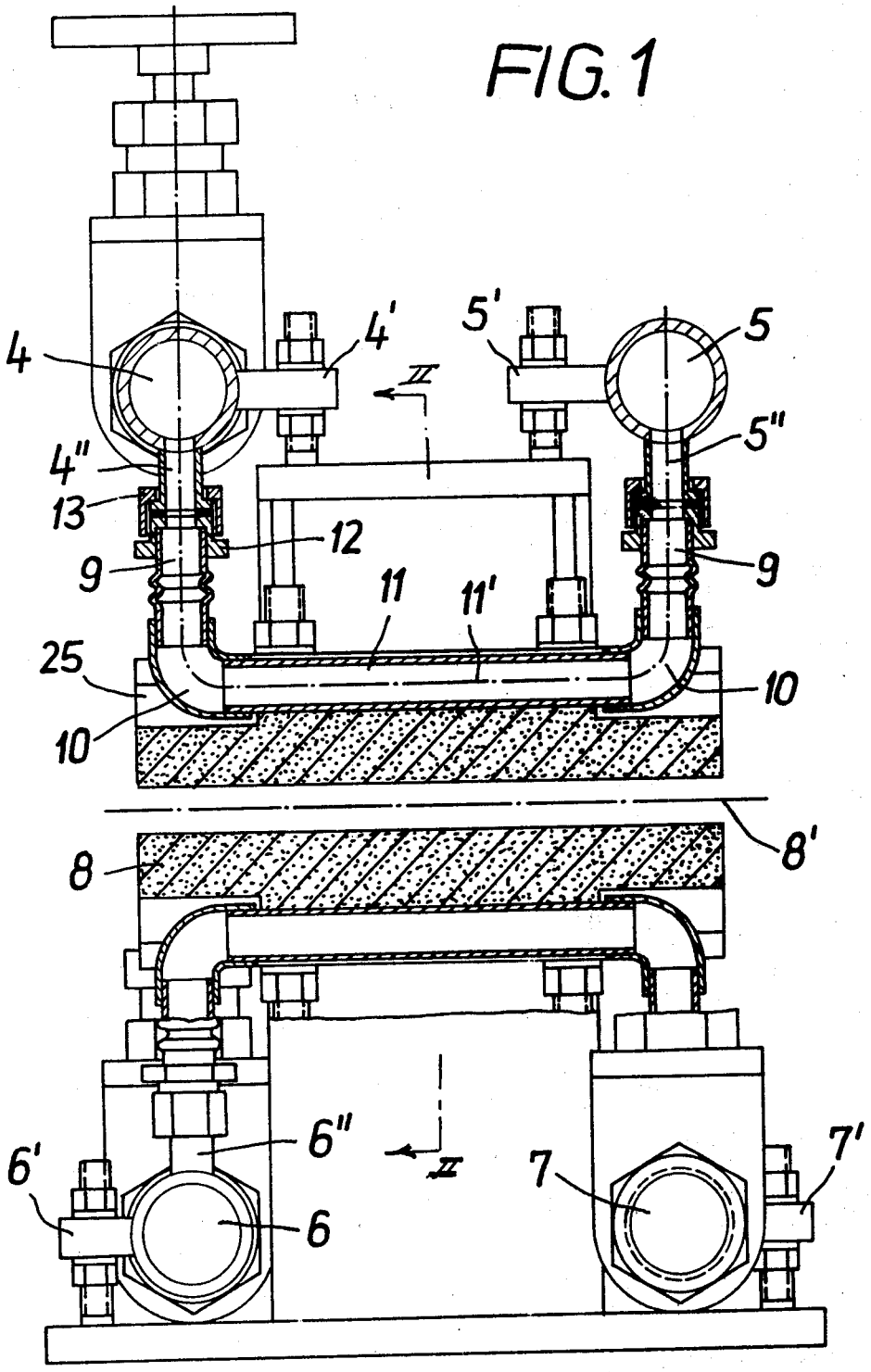
FIG. 1 represents a vertical longitudinal section through the continuous mold according to the invention.
Figure 2:
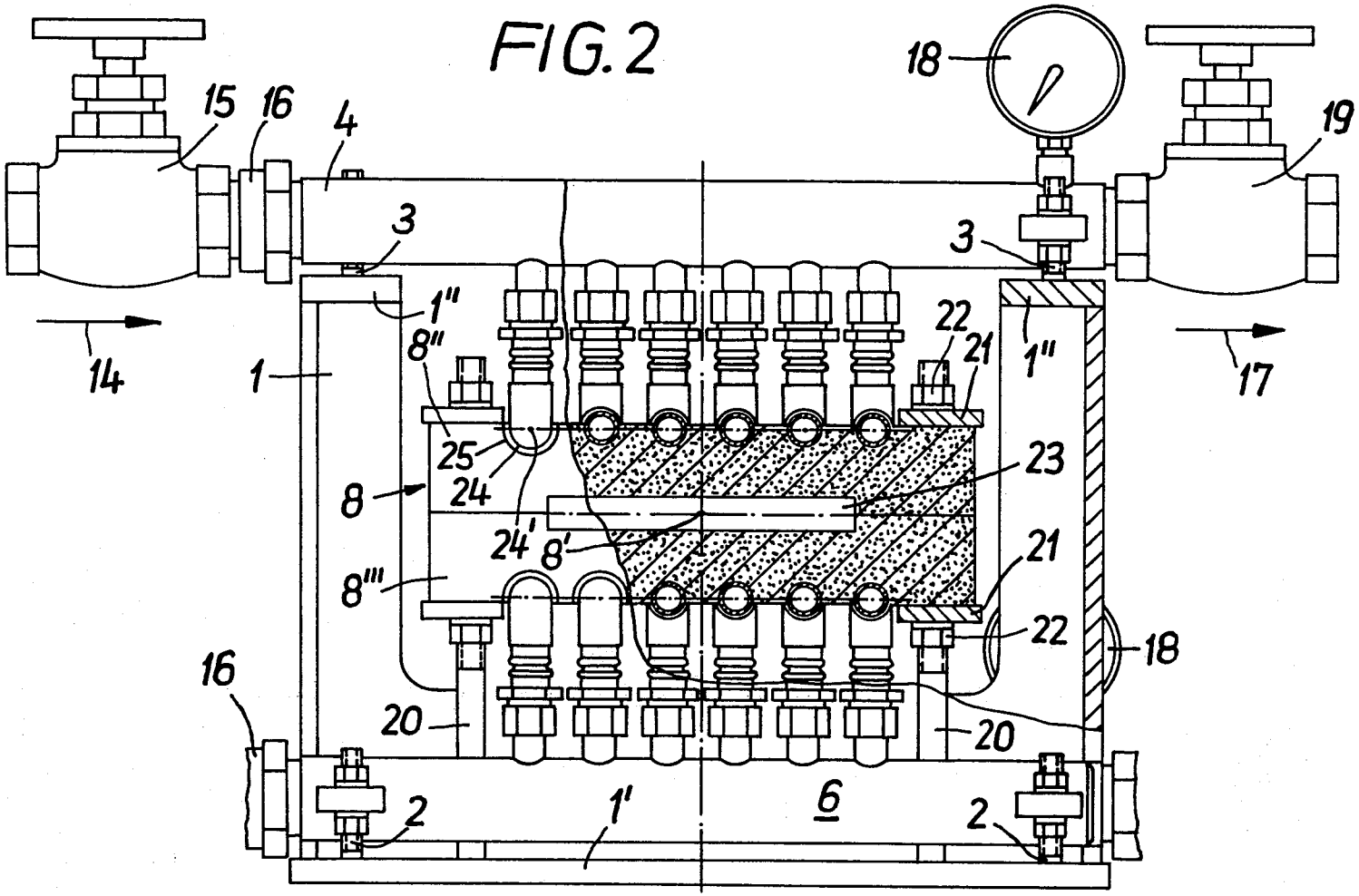
FIG.2 represents a vertical section transverse to the longitudinal axis of the continuous casting mold according to the invention, said section being taken along the line II—II of FIG. 1.

Referring now to the drawings in detail, the continuous mold shown therein comprises as supporting element a supporting frame 1 with a bottom plate 1' and upper supporting plates 1'' to which threaded bolts 2 and 3 are respectively connected. An upper inlet manifold or feeding pipe 4 and an upper outlet manifold or discharge pipe 5 are screwed to the threaded bolts 3 while interposing welded-on plates 4' and 5'. A lower inlet manifold or feeding pipe 6 and a lower outlet manifold or discharge pipe 7 are in a corresponding manner, while interposing welded-on plates 6' and 7' connected to the lower threaded bolts 2. Welded to the feeding pipes as well as to the discharge pipes are pipe connections of which only the pipe connections 4'' to 6'' are shown, which are followed by U-shaped pipe systems. There is also a corresponding pipe connection with regard to the discharge pipe 7, which, however, is not visible in FIG. 1. In other words, the connection between the lower discharge pipe 7 and the pertaining lower straight cooling pipes 11 is designed in the same manner as the connection between the upper pipes 4,5 and the pertaining upper cooling pipes 11. The said pipe connections are arranged at equal distances in the direction toward the graphite block 8. The U-shaped pipe systems respectively comprise two metal compensators 9, two elbow pipes 10 and a straight cooling pipe 11 the longitudinal axis 11' of which extends parallel to the longitudinal axis 8' of the graphite block 8.

The metal compensators 9 are, through the intervention of threaded bushings 12 connected thereto and a box nut 13, adjustably connected to the respective pertaining pipe sections 4'' and 5''.

The feeding pipe 4 is in feeding direction (arrow 14) provided with a quantity control valve 15 with means 16 for measuring the quantity of warm water. A pressure gauge 18 and a control valve 19 are built into the discharge conduit 5 in the discharge direction (arrow 17). The lower feeding pipe 6 and the lower discharge pipe 7 are equipped with corresponding devices which for the sake of simplicity have not been shown.

The graphite block 8 consisting of an upper part 8'' and a lower part 8''' is by means of threaded bolts 20 held in the rigid supporting frame 1. The two parts 8'' and 8''' are by the interposition of clamping plates 21 clamped relative to each other by clamping nuts 22 and surround a rectangular mold chamber 23. The upper and lower parts of the graphite block are on that side which is directed outwardly, in other words on the top and bottom side, provided with grooves 24 the longitudinal axes 24' of which extend parallel to the longitudinal axis 8'. The straight cooling pipes 11 are outside the region of the elbow pipes 10 under a slight preload, caused by the metal compensators 9, held in engagement with the grooves 24. In the region of the elbow pipes 10, i.e. in the region of the front and rear end sections, the graphite block is provided with recesses 25 the cross section of which is larger than the cross section of the elbow pipes 10 engaging in this region.

After opening the control valves 19, the cooling fluid pressure prevailing in the cooling circuit can be read on the pressure gauge 18. Inasmuch as the metal compensators 9, under the effect of the hydrostatic pressure, expand in the direction of their longitudinal axes, the cooling pipes 11 are elastically brought into engagement with the grooves 24. During the operation of the continuous mold, there thus exists an intimate contact between the graphite block and the cooling pipes 11. A separation between the cooling pipes and the graphite block as a result of different thermal expansion of the structural elements which contact each other cannot occur.

Inasmuch as the pressure of the cooling fluid can be precisely controlled in wide limits by means of the quantity of the throughflow determined by the quantity control valves 15, a corresponding fine setting of the pressing-on force exerted by the cooling pipes 11 is possible. An undesired deformation of the graphite block 8 can therefore be avoided, even when the graphite block has a rather great width.

Therefore, the new continuous mold according to the invention is particularly well suited for the casting of wide strands.

According to a modification of the present invention, the graphite block 8 may also at its narrow sides be provided with cooling pipes which are connected in the above described manner to the feeding and discharge pipes. Such a construction of the continuous mold is suited in particular for casting plates capable of being hot rolled with a thickness ranging from 80 to 250 mm.

The continuous mold may expediently also be designed in such a way that the cooling pipes 11 and, correspondingly, the grooves 24 as well as the recesses 25, if desired, have a rectangular cross section.

In order to increase the cooling effect and thereby the casting output, the above described indirectly cooled continuous mold may, in the region of the end faces of the graphite block, be connected to a direct cooling system.

It is, of course, to be understood that the present invention is by no means limited to the specific showing in the drawings but also encompasses any modificaton within the scope of the appended claims.

What is claim is:

1. An apparatus for continuous casting of metal comprising:

a graphite mold block having a molding chamber extending in a first direction therethrough;

a base;

means for supporting the graphite mold block in fixed relation with respect to the base;

a cooling system disposed exterior of the graphite mold block;

means for supporting the cooling system exterior of and separately from the graphite mold block;

the cooling system comprising:

a plurality of cooling pipes extending in the same direction as the molding chamber, each pipe having an inlet at one end and an outlet at the other end;

cooling fluid feeding means;

cooling fluid discharge means, and expandable compensator joints connecting the inlets of the cooling pipes to the fluid feeding means and for connecting the outlets of the cooling pipes to the discharge means, said expandable compensating joints also supporting the cooling pipes adjacent the graphite mold block, whereby upon supplying cooling fluid at a static pressure sufficient to expand the expandable compensating joints, the cooling pipes are urged into abutment with the graphite mold block and remain in abutment regardless of expansion and contraction due to thermal gradients and variations.

2. The apparatus of claim 1 wherein the surface of the graphite mold block adjacent to the cooling pipes includes a plurality of grooves aligned with the pipes for receiving the pipes.

3. The apparatus of claim 1 wherein the means for supporting the cooling system separately from the graphite mold block includes means for supporting the cooling pipes both above and below the graphite mold block.

4. The apparatus of claim 1, 2, or 3 further including means for monitoring and controlling the static pressure of the cooling fluid to insure contact between the cooling pipes and graphite mold block.

5. An apparatus for casting copper and copper alloys continuously comprising:

a graphite mold block having a molding chamber of rectangular cross section extending therethrough, said block having upper and lower surfaces with grooves extending therein parallel to the molding chamber;

means for supporting the graphite mold block;

cooling circuit means supported exteriorly and separately from the graphite mold block, said cooling circuit means including:

upper and lower inlet manifolds for feeding coolant above and below the graphite mold block;

upper and lower outlet manifolds for discharging coolant above and below the graphite mold block;

cooling pipes positioned adjacent the upper and lower surfaces of the graphite mold block for transporting coolant adjacent to the upper and lower surfaces to carry heat away from the graphite mold block;

connecting means for connecting each cooling pipe to an outlet of the inlet manifold and an inlet of the outlet manifold and for supporting each cooling pipe independently of the graphite molding block, the connecting means including:

a vertically oriented expandable section connected directly to a manifold; and an elbow connecting the expandable section to a pipe; and means for controlling static pressure of coolant supplied to the upper and lower inlet manifolds whereby the cooling pipes are held in abutment with the graphite molding block during thermal expansions and contractions due to the expandable sections expanding and contracting to accommodate the thermal expansion and contractions.

* * * * *